US009215521B2

(12) United States Patent
Lee

(10) Patent No.: US 9,215,521 B2
(45) Date of Patent: Dec. 15, 2015

(54) EARPHONE SYSTEM FOR MOBILE DEVICES

(75) Inventor: Woo Cheol Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 799 days.

(21) Appl. No.: 13/421,065

(22) Filed: Mar. 15, 2012

(65) Prior Publication Data

US 2012/0237051 A1 Sep. 20, 2012

(30) Foreign Application Priority Data

Mar. 15, 2011 (KR) ..... 10-2011-0022869

(51) Int. Cl.

| | |
|---|---|
| ***H04R 1/10*** | (2006.01) |
| ***H04R 25/00*** | (2006.01) |
| ***H01R 13/66*** | (2006.01) |
| ***H01R 24/58*** | (2011.01) |
| *H01R 105/00* | (2006.01) |
| *H01R 107/00* | (2006.01) |

(52) U.S. Cl.

CPC ..... *H04R 1/1041* (2013.01); *H01R 13/66* (2013.01); *H01R 24/58* (2013.01); *H01R 2105/00* (2013.01); *H01R 2107/00* (2013.01)

(58) Field of Classification Search

CPC .... H04R 5/033; H04R 1/1041; H04R 1/1016; H04R 29/001; H04R 3/007; H04R 5/04; H04R 2420/05; H03G 1/0088

USPC ..... 381/74, 77, 80, 81, 104, 111, 122, 123, 381/309, 370, 384

See application file for complete search history.

(56) References Cited

U.S. PATENT DOCUMENTS

| | | | | |
|---|---|---|---|---|
| 2004/0175993 | A1 | 9/2004 | Chennakeshu | |
| 2004/0204185 | A1 | 10/2004 | Snyder et al. | |
| 2008/0032753 | A1* | 2/2008 | Nho | 455/569.1 |
| 2008/0137896 | A1 | 6/2008 | Tsen | |
| 2009/0130910 | A1 | 5/2009 | Inha et al. | |
| 2009/0136058 | A1* | 5/2009 | Choi et al. | 381/74 |
| 2010/0215183 | A1* | 8/2010 | Hansson et al. | 381/58 |
| 2011/0216912 | A1* | 9/2011 | Seo | 381/74 |

* cited by examiner

*Primary Examiner* — Vivian Chin
*Assistant Examiner* — William A Jerez Lora
(74) *Attorney, Agent, or Firm* — Jefferson IP Law, LLP

(57) ABSTRACT

An earphone system for a mobile device is provided. The earphone system includes an earphone interface with a plurality of contacts for accepting an earphone jack corresponding to 3- or 4-pole earphones, a controller with a plurality of ports for communicating with the earphones that are connected to the earphone interface via the earphone jack, and an earphone compatible circuit. The earphone compatible circuit controls the connection states between the contacts of the earphone interface and the ports of the controller, according to the type of earphone jack inserted into the earphone interface. The earphone compatible circuit connects corresponding contacts of the earphone jack to ports of the controller.

19 Claims, 12 Drawing Sheets

EARPHONE SYSTEM FOR MOBILE DEVICES

PRIORITY

This application claims the benefit under 35 U.S.C. §119 (a) of a Korean patent application filed on Mar. 15, 2011 in the Korean Intellectual Property Office and assigned Serial No. 10-2011-0022869, the entire disclosure of which is hereby incorporated by reference.

BACKGROUND OF THE INVENTION

1. Field of the Invention

This invention relates to an earphone system. More specifically, the present invention relates to an earphone system that provides compatibility to earphones so that the earphones can be connected to a mobile device.

2. Description of the Related Art

Mobile devices, such as mobile communication devices, Personal Digital Assistants (PDAs), etc., are widely used because the mobile devices are easily carried and because the mobile devices provide a variety of functions. Mobile communication devices are equipped with a mobile communication module that is configured to communicate with other devices via a base station so as to transmit and/or receive voice and data information. PDAs are designed to include central processing units (CPUs), memory devices, an Operating System (OS), applications configured to operate with the OS, and function modules, etc. PDAs are configured to perform a variety of functions, such as the collection, the creation, the search and the storage of information.

Functions associated with file playback (e.g., the playback of an audio file), or call transmission are functions that output audio signals. For example, the audio signals may be signals that the mobile device receives from external systems. The audio signals may also be generated by the mobile device when the mobile device plays back a stored audio file. As another example, the audio signals may be generated when the mobile device communicates during a voice transmission. Although audio signals are generally output via a speaker, some mobile device users use earphones to ensure the audio sound has better clarity, or to prevent the audio sound from being shared with others in the surrounding environment.

Mobile devices are equipped with an earphone interface (e.g., plug) that is configured to accept a variety of jacks for earphones (i.e., earphone jacks). Earphone interfaces may be designed in various types according to the various sizes of earphone jacks. Although earphone jacks are designed to be the same size, earphone jacks may have different features. This design variation is reflected in the configuration of the earphone interfaces. For example, an earphone interface may be designed to support 3- or 4-pole earphones according to the number of poles (contacts) in the earphone jack. In addition, although earphone interfaces are manufactured with the same number of poles, the design of earphone interfaces differ in order to support a variety of earphones each of which may have earphone jacks that are designed differently based on the geographical region in which the earphones are sold. For example, earphones sold in US and European markets differ from each other in arrangement of the poles of the jacks, and thus such variation in the arrangement of the poles of the earphone jacks necessitates an earphone interface design which interfaces with the variety of different earphone jacks. Therefore, because conventional earphone interfaces for mobile devices must be designed according to the various types of earphone jacks, manufacturers have difficulty in manufacturing mobile devices. In particular, when mobile device users have earphones compatible with the earphone interfaces of the mobile devices, the users are unable to use them.

SUMMARY OF THE INVENTION

Aspects of the present invention are to address at least the above-mentioned problems and/or disadvantages and to provide at least the advantages described below. Accordingly, an aspect of the present invention is to provide an earphone system with an interface of a mobile device that can provide compatibility to a jack for earphones so that the jack can be connected to the interface, irrespective of types of jack.

In accordance with an exemplary embodiment of the present invention, an earphone system for a mobile device is provided. The earphone system includes an earphone interface with a number of contacts for accepting an earphone jack for 3- or 4-pole earphones, a controller with a number of ports for communicating with the earphones that are connected to the earphone interface via the earphone jack, and an earphone compatible circuit. The earphone compatible circuit controls the connection states between the contacts of the earphone interface and the ports of the controller, according to the type of the earphone jack inserted to the earphone interface, and connects corresponding contacts of the earphone jack to the ports of the controller.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will become more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Although the drawings represent exemplary embodiments of the invention, the drawings are not necessarily to scale and certain features may be exaggerated or omitted in order to better illustrate and explain the present invention.

Figure 1:
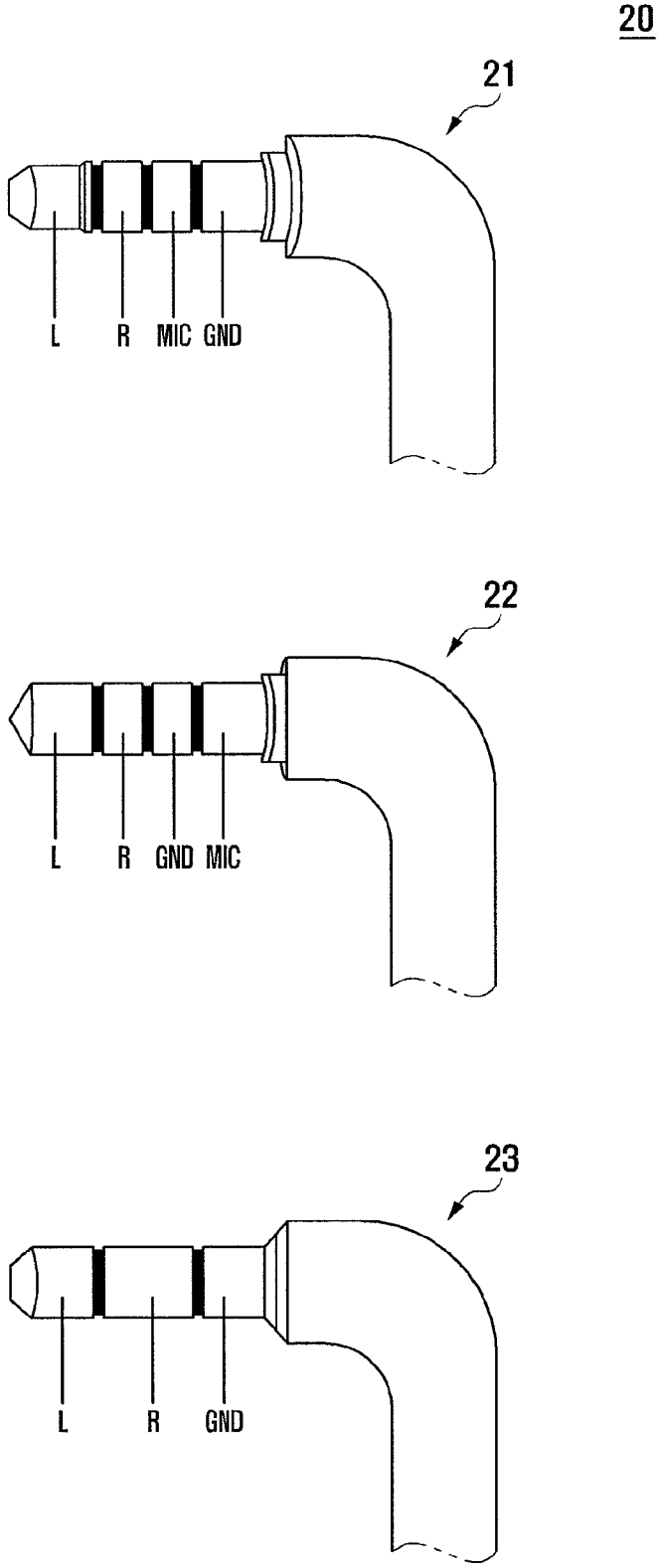
FIG. 1 illustrates various types of earphone jacks that can be plugged into an earphone interface for mobile devices, according to an exemplary embodiment of the present invention.

FIG. 1 illustrates various types of earphone jacks that can be plugged into an earphone interface for mobile devices, according to an exemplary embodiment of the present invention.

Referring to FIG. 1, an earphone jack at the top of FIG. 1 (hereinafter, first earphone jack 21) has four poles or contacts—left L and right R audio signal contacts, a microphone contact MIC, and a ground contact, in order, from the left. Another earphone jack at the middle of FIG. 1 (hereinafter, second earphone jack 22) has four poles or contacts—left L and right R audio signal contacts, a ground contact, and a microphone contact MIC, in order, from the left. The earphone jack at the bottom of FIG. 1 (hereinafter, third earphone jack 23) has three poles or contacts, left L and right R audio signal contacts, and a ground contact, in order, from the left. The first earphone jack 21 is designed for 4-pole European type earphones. The second earphone jack 22 is designed for 4-pole US type earphones. 3- or 4-pole earphones may be classified into short-key mode earphones and open-key mode earphones according to the detection of pressing an earphone key. For example, short-key type earphones are designed such that, when the earphone key is pressed, the earphone key is connected to the ground contact in the earphones. In contrast, open-key type earphones are designed such that, when the earphone key is pressed, the microphone circuit path is broken to the ground contact in the earphones. That is, short-key type earphones are designed such that, when the earphone key is not pressed, the controller of the mobile device can detect a 'High' level of signal from the earphones. Open-key type earphones are designed such that, when the earphone key is pressed, the controller of the mobile device can detect a 'High' level of signal from the earphones via a pull-up voltage of the microphone bias. For purposes of conciseness and clarity, in the following description, the first earphone jack 21, second earphone jack 22, and third earphone jack 23 are commonly referred to as earphone jack 20.

Figure 2:
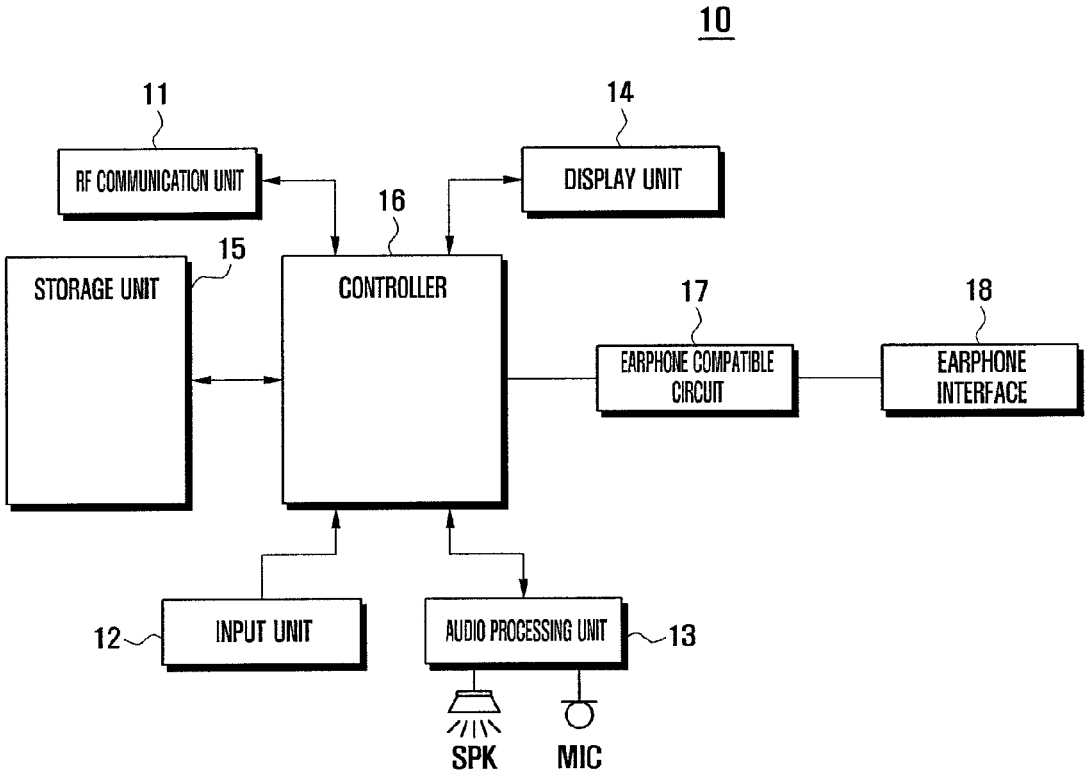
FIG. 2 illustrates a schematic block diagram of a mobile device according to an exemplary embodiment of the present invention.

FIG. 2 illustrates a schematic block diagram of a mobile device according to an exemplary embodiment of the present invention.

Referring to FIG. 2, mobile device 10 includes an RF communication unit 11, an input unit 12, an audio processing unit 13, a display unit 14, a storage unit 15, an earphone compatible circuit 17, an earphone interface 18, and a controller 16.

When the earphone interface 18 accepts the earphone jack 20 of the earphones, the earphone compatible circuit 17 identifies a feature of the earphone jack 20 and establishes a circuit path according to the feature. For example, the earphone compatible circuit 17 may establish an audio signal path or a microphone path. In the following description, the configurations and operations of the components in the mobile device 10 are described in detail, so that they can support the compatibility with earphones (i.e., the jacks).

The RF communication unit 11 refers to a module for providing mobile communication services to the mobile device 10. The RF communication unit 11 may be implemented with a GSM or CDMA module according to a mobile communication mode. The RF communication unit 11 establishes a communication channel with mobile communication systems. To this end, the RF communication unit 11 may include an RF transmitter for up-converting the frequency of signals to be transmitted and for amplifying the signals, and an RF receiver for low-noise amplifying received RF signals and for down-converting the frequency of the received RF signals. The RF communication unit 11 may or may not be included in the mobile device 10 according to the type of mobile device. For example, if the mobile device 10 supports a mobile communication function in which the mobile device 10 communicates with base stations, then the mobile device includes the RF communication unit 11. However, if the mobile device 10, such as a monitor or an audio player, does not need a mobile communication function, the mobile device 10 may not include the RF communication unit 11. The RF communication unit 11 establishes, according to the request of the user of the mobile device 10, a call channel with at least one other mobile device and operatively transmits/receives audio signals to/from the at least one other mobile device via the channel. The RF communication unit 11 receives audio signals and transfers the audio signals to the earphones via the earphone jack 20 that is operatively connected to the earphone interface 18 and the earphone compatible circuit 17.

The input unit 12 may include input keys and/or function keys that allow a user to input numbers or letter information and to set a variety of functions. The function keys include direction keys, side keys, shortcut keys, etc., which are set to perform specific functions. The input unit 12 creates key signals for setting user's options and for controlling functions of the mobile device 10 and transfers the key signals to the controller 16. In an exemplary embodiment of the present invention, the input unit 12 creates a number of input signals for controlling the user's function and transfers the input signals to the controller 16. Examples of the input signals include a signal created when a phone number is input or a phone number in a phone book is selected; a signal created when the mobile device 10 is making a call based on the selected phone number; a signal created when a file in the storage unit 15 is selected or otherwise played back; etc.

The audio processing unit 13 may include a speaker (SPK) for reproducing audio signals from the controller 16 and/or a microphone (MIC) for receiving audio signals via a corresponding application program executed in the mobile device 10. The audio processing unit 13 outputs, to the speaker (SPK), audio signals that are received via the RF communication unit 11 or audio signals that are created when corresponding contents are played back. The audio processing unit 13 establishes an audio input path between the microphone (MIC) and the earphone interface 18 and an audio output path between the speaker (SPK) and the earphone interface 18. When the earphone interface 18 accepts the earphone jack 20 of the earphones, the audio processing unit 13 breaks at least one of the audio input and output paths between the earphone interface 18 and the speaker (SPK) and the microphone (MIC) of the mobile device 10, and instead establishes a corresponding audio input and output paths with a microphone and/or a speaker of the earphones via a microphone contact and a speaker contact of the jack 20. For example, when 3-pole earphones are connected to the mobile device 10, the audio processing unit 13 establishes only an audio output path via the jack 20, and maintains the audio input path (e.g., the audio input path between the earphone interface 18 and the MIC of the mobile device 10). The audio processing unit 13 switches the audio paths according to the control of the controller 16.

The display unit 14 displays menus of the mobile device 10, information input by a user, and/or information provided to the user. The display unit 14 may provide various types of screens according to the operations of the mobile device 10. For example, the display unit 14 may provide an idle screen, menu screens, a message writing screen, a call screen, etc. In an exemplary embodiment of the present invention, the display unit 14 may be operated in a variety of modes according to the connection states of the earphone interface 18. For example, when the earphone interface 18 accepts the earphone jack 20 of the earphones during a call, the display unit 14 is automatically turned off, thereby reducing the consumption of electric power in the mobile device 10. In addition, when an input signal is created to supply electric power, the display unit 14 is turned on and displays a screen immediately before being turned off. Further, when the earphone interface 18 operatively connects with earphones via the earphone jack 20, the display unit 14 outputs a message informing the user of the connection of the earphones. In another embodiment, the earphones connection message may not be output on the display unit 14 according to the user's settings. Although the earphone interface 18 accepts the earphone jack 20, the display unit 14 may maintain an execution screen of an application program, instead of being automatically turned off. The display unit 14 may be implemented with a Liquid Crystal Display (LCD), an Organic Light Emitting Diode (OLED), or the like. If the display unit 14 is implemented with a touch screen, then the display unit 14 may also serve as an input device. A touch screen includes a touch panel and touch sensors arranged thereon. Further, if the display unit 14 is implemented with a touch screen, the mobile device 10 may provide a variety of touch screen-based menus.

The storage unit 15 stores application programs for executing functions according to the present invention. The storage unit 15 also stores application programs for reproducing various types of files. In addition, when the mobile device 10 is equipped with a touch screen, the storage unit 15 stores a key map and a menu map to operate the touch screen. The key map and menu map can be implemented in various modes. For example, the key map may be a keyboard map, a 3×4 key map, a QWERTY key map, etc. The key map may also be a control key map for controlling an application program that is currently activated. The menu map may be a menu map for controlling an application program that is currently activated. The menu map may also be a menu map containing various types of menu items provided by the mobile device 10, etc. The storage unit 15 includes a program storage area and a data storage area.

The program storage area stores an Operating System (OS) for booting the mobile device 10 and for controlling the entire operation of the components in the mobile device 10, and application programs for reproducing a variety of files. Examples of the application programs are an audio application for playing back audio files, such as MP3 files, an image application for reproducing photographs, a video reproducing application, etc. In an exemplary embodiment of the present invention, the program storage area stores an earphone jack application for supporting an earphone jack function.

The earphone jack application may be activated when the earphone interface 18 accepts the earphone jack 20 of the earphones. The earphone jack application identifies the type of jack (e.g., whether the earphone jack 20 corresponds to a first earphone jack 21, a second earphone jack 22, a third earphone jack 23, etc.), and controls the earphone compatible circuit 17 for switching an audio path to the inserted earphone jack 20. To this end, the earphone jack application includes a number of sub-routines: for example, for detecting whether the earphone interface 18 accepts a jack and identifying the type of jack; for controlling the switching operation of the earphone compatible circuit 17 according to the identified type of jack; and for transmitting/receiving signals to/from the earphones via the earphone jack 20.

The data storage area stores data generated when the mobile device 10 is used. For example, the data storage area may store a variety of contents according to the features of the mobile devices. When the display unit 14 is implemented with a touch screen, the data storage area may store data that the user input via the touch screen.

Figure 3:
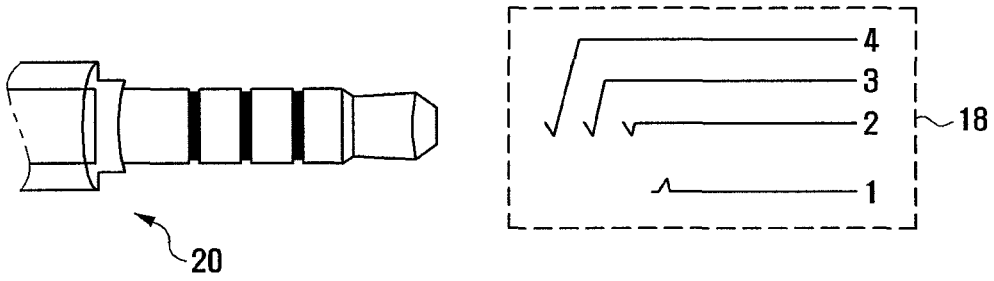
FIG. 3 illustrates a schematic view showing a configuration of an earphone interface according to an exemplary embodiment of the present invention.
Figure 4:
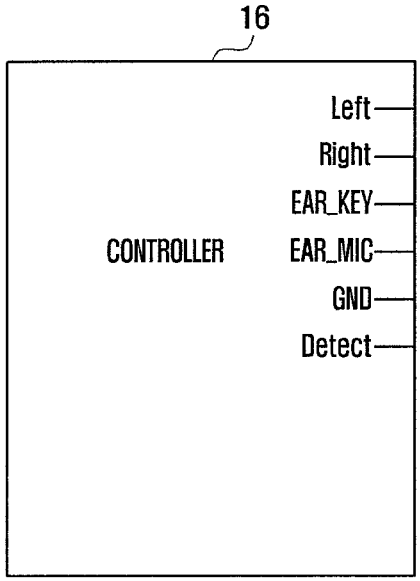
FIG. 4 illustrates ports of a controller according to an exemplary embodiment of the present invention.

FIG. 3 illustrates a schematic view showing a configuration of an earphone interface according to an exemplary embodiment of the present invention. FIG. 4 illustrates ports of a controller according to an exemplary embodiment of the present invention.

The earphone interface 18 as shown in FIG. 3 is installed to one side of the mobile device 10 and operatively receives the earphone jack 20 of the earphones. The earphone interface 18 includes contacts 1, 2, 3, and 4 that can contact the earphone jack 20 irrespective of types of earphones (e.g., 3- or 4-pole earphones). The contacts 1, 2, 3, and 4 transmit/receive data to/from the earphones via earphone jack 20. Contacts 1 and 2 respectively connect with the left and right output contacts of the earphone jack 20 of the earphones. Contact 3 connects with a different contact of the earphone jack 20 according to the type of earphone jack 20 operatively engaged with the earphone interface 18. For example, if the earphone interface 18 accepts the first earphone jack 21 corresponding to 4-pole European type earphones shown in FIG. 1, then contact 3 connects with an earphone microphone contact of the first earphone jack 21. Likewise, if the earphone interface 18 accepts the second earphone jack 22 corresponding to 4-pole US-type earphones shown in FIG. 1, then contact 3 connects with the ground contact (GND) of the second earphone jack 22. If the earphone interface 18 accepts the first earphone jack 21 shown in FIG. 1, contact 4 connects with the ground contact (GND) of the second earphone jack 22. Likewise, if the earphone interface 18 accepts the second earphone jack 22 shown in FIG. 1, then contact 4 connects with an earphone microphone contact (MIC) of the second earphone jack 22. If the earphone interface 18 accepts the third earphone jack 23, then contacts 3 and 4 both connect with the ground contact (GND). The earphone interface 18 may be designed to include a number of contacts to connect to various types of jacks. For example, as shown in FIG. 3, the earphone interface 18 includes four contacts; however it may be modified to include more contacts, e.g., five shown in FIG. 5, than the embodiment of FIG. 3.

The earphone compatible circuit 17 is configured between the earphone interface 18 and the controller 16. The earphone compatible circuit 17 switches circuit paths according to the type of earphone jack 20 plugged into the earphone interface 18. Therefore, the earphone compatible circuit 17 can transfer signals between the earphone jack 20 of the earphones and the controller 16 irrespective of the types of jacks. A detailed description of the earphone compatible circuit 17 will be provided, later, referring to FIGS. 5 to 12.

The controller 16 controls the electric power supply to components in the mobile device 10 and initializes such components. After completing the initialization, the controller 16 controls a user function according to the connection of the earphone jack 20 of the earphones. For example, the controller 16 controls the earphone compatible circuit 17 to transmit/receive signals to/from the earphone jack 20 via the earphone interface 18. The controller 16, as shown in FIG. 4, includes a number of ports for supporting the connection to the earphone jack 20 of the earphones. That is, the controller 16 includes left LEFT and right RIGHT output ports, an earphone key port EAR_KEY, an earphone microphone port EAR_MIC, a ground port GND, and a detection port DETECT. The controller 16 outputs audio signals to the earphone jack 20 via the left LEFT and right RIGHT output ports. The controller 16 receives a signal, via the earphone key port EAR_KEY, from the earphones when the earphone key of the earphones is operated, and performs the corresponding function. When the earphone interface 18 accepts the third earphone jack 23 (e.g., as illustrated in FIG. 1) for the 3-pole earphones, the earphone microphone port EAR_MIC is connected to the ground contact GND. The controller 16 controls the earphone compatible circuit 17 via the ports and establishes paths to the earphone interface 18. Therefore, the controller 16 can output signals via the ports to the earphone interface 18 connected to the earphone jack 20, irrespective of the types of jacks. To this end, the earphone compatible circuit 17 performs switching operations according to the features of the jack connected to the earphone interface 18.

Figure 5:
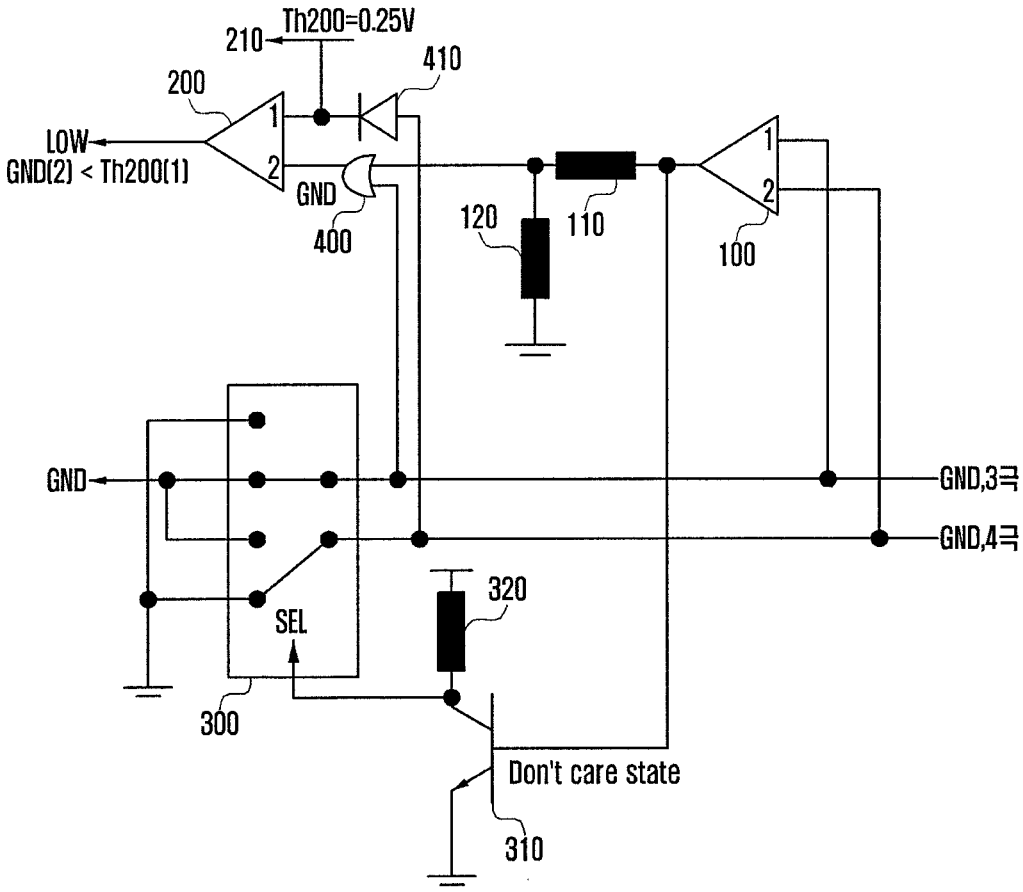
FIG. 5 illustrates an earphone compatible circuit according to an exemplary embodiment of the present invention.

FIG. 5 illustrates an earphone compatible circuit according to an exemplary embodiment of the present invention.

Referring to FIG. 5, the earphone compatible circuit 17 includes a first comparator 100, a second comparator 200, a selector 300, a switch 310, an OR gate 400, and a diode 410.

The first comparator 100 is connected to signal lines of contacts 3 and 4 of the earphone interface 18 via the corresponding input ports 1 and 2, and is connected to a voltage divider via the first comparator output port. The voltage divider may include resistor 110 and resistor 120. The voltage divider operatively connects the first comparator output port to the input port of the OR gate 400. The first comparator 100 connects the first comparator output port to the base of the switch 310 that is connected to the selection port SEL of the selector 300. The selector 300 includes two input ports connected to contacts 3 and 4 of the earphone interface 18 and four output ports that are connected to the two input ports according to the control signal input via the selection port SEL. The four output ports are connected to the controller 16 according to the switching states of the selector 300. In the following description, for the sake of convenience, the four output ports of the selector 300 are numbered 1 to 4 from the top to the bottom. Likewise, the two input ports are numbered 1 and 2 from the top to the bottom.

The state of the selector 300 shown in FIG. 5 shows an exemplary configuration in which the earphone interface 18 accepts the third earphone jack 23 shown in FIG. 1. The second comparator 200 connects the corresponding input ports 1 and 2 to the cathode of the diode 410 and the output of the OR gate 400, respectively. The node between the input port 1 of the second comparator 200 and the cathode of the diode 410 may also be connected to a reference voltage supply 210. Meanwhile, because the left LEFT and right RIGHT output ports of the controller 16 are connected to the contacts L and R of the earphone jack 20 in a conventional mode, a detailed description of the paths established therebetween will be omitted in this application.

The OR gate 400 operatively receives the output of the first comparator 100, via the voltage divider, and the contact 3 of the earphone interface 18. The OR gate 400 outputs an output to the second port 2 of the second comparator 200. The diode 410 connects the anode to the contact 4 of the earphone interface 18.

The switch 310 may be implemented with an NPN device. The switch 310 is configured in such a way that the base is connected to the output of the first comparator 100, the collector is connected to a voltage supply via a third resistor 320 as a pull-up resistor, and the emitter is grounded. The collector is also connected to the selection port SEL of the selector 300, and outputs the output thereto according to the output of the first comparator 100 which is input to the base of the switch 310.

In contrast to jacks corresponding to 4-pole earphones, if the third earphone jack 23 for 3-pole earphones is inserted into the earphone interface 18, contacts 3 and 4 of the earphone interface 18 are grounded. That is, because the inputs of the first comparator 100 are grounded, the first comparator 100 outputs a low level of voltage. In that case, the OR gate 400 receives a low level of voltage from the contact 3 and the output of the first comparator 100, and outputs a low level of voltage. The second comparator 200 receives, via the input port 2 of the second comparator, the low level of voltage from the OR gate 400. On the other hand, because the anode of the diode 410 is grounded, the second comparator 200 receives a voltage value of the reference voltage supply 210 (e.g., 0.25 V) via the first input port 1 of the second comparator. In an exemplary embodiment of the present invention, it is assumed that the second comparator 200 is set to output a low level of voltage if the input port 1 receives a higher level of voltage than the input port 2. Therefore, the second comparator 200 inputs 0.25 V and a low level of voltage via the input ports 1 and 2, respectively. Accordingly, the second comparator 200 outputs a low level of voltage to the controller 16. If the controller 16 receives a low level of voltage via the detection port DETECT and the key input port, it identifies that the earphone interface 18 accepts a type of third earphone jack (e.g., earphone jack 23 illustrated in FIG. 1) for 3-pole earphones. In that case, the selector 300 does not care whether the input ports are connected to the output ports because both input ports are grounded. Likewise, the switch 310 does not care whether the base receives a high or low level of voltage. Although the first exemplary embodiment is implemented in such a way that the reference voltage supply 210 outputs 0.25 V, it should be understood that the present invention is not limited to such an exemplary embodiment.

Figure 6:
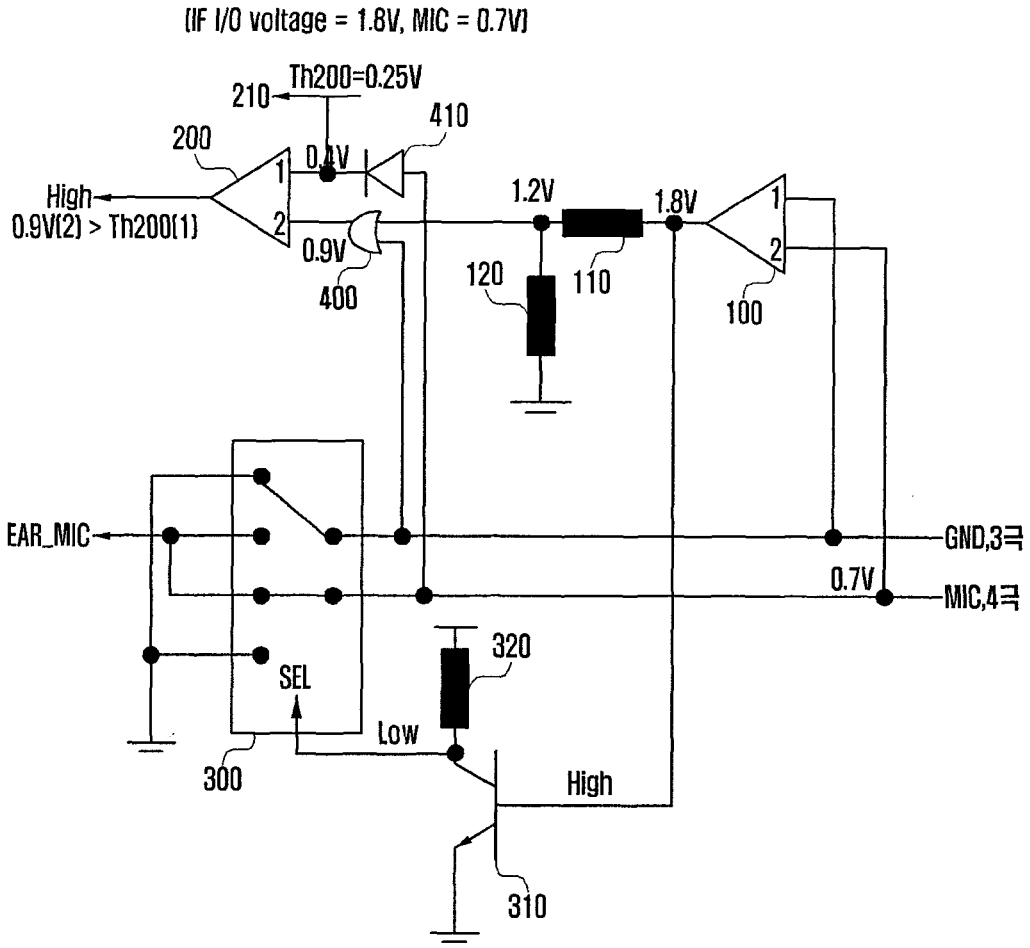
FIG. 6 illustrates an earphone compatible circuit to describe a detection of a 4-pole earphone jack, according to an exemplary embodiment of the present invention.

FIG. 6 illustrates an earphone compatible circuit to describe a detection of a 4-pole earphone jack according to an exemplary embodiment of the present invention. For the sake of convenient description, it is assumed that an I/O voltage is 1.8 V, an earphone microphone voltage for the port EAR_MIC of controller 16 is 0.7 V, and a microphone bias voltage is 1.8 V.

Referring to FIG. 6, if the earphone compatible circuit 17 is operatively connected with the second earphone jack 22 (e.g., as illustrated in FIG. 6) corresponding to 4-pole US type earphones via the earphone interface 18, the first comparator 100 receives a ground level of voltage via the input port 1 of the first comparator, and 0.7 V, as an earphone microphone voltage for EAR_MIC port, via the input port 2 of the first comparator. Because the first comparator 100 receives a larger level of input (i.e., 0.7 V) via the input port 2 than via the input port 1, the first comparator 100 outputs a high level of voltage. In that case, the first comparator 100 outputs the I/O voltage (i.e., 1.8 V) as a high level of voltage. The output of the first comparator 100 is divided by the voltage divider of first 110 and second 120 resistors, and then the divided voltage is input to the input port of the OR gate 400. In an exemplary embodiment of the present invention, it is assumed that the voltage divider designed the first 110 and second 120 resistors so as to divide 1.8 V and to output 1.2 V. Therefore, the OR gate 400 receives 1.2 V from the first comparator 100. In another exemplary embodiment of the present invention, the first comparator 100 may be designed to output a proper voltage (e.g., 1.2 V) such that the earphone compatible circuit 17 may be implemented without the voltage divider.

If the OR gate 400 receives 1.2 V from the first comparator 100 the physical characteristics of the circuit causes a voltage drop (e.g., 0.3 V). Accordingly, the OR gate 400 outputs 0.9 V. It is assumed that the physical characteristics of diode 410 also cause a voltage drop of 0.3 V. In that case, if the diode 410 receives an earphone microphone voltage (e.g., 0.7 V), then the diode 410 outputs an output of 0.4 V due to the voltage drop of 0.3 V.

Therefore, the second comparator 200 receives 0.9 V from the OR gate 400 via the input port 2 and 0.4 V from the cathode of the diode 410 via the input port 1. It is assumed that the second comparator 200 is designed to output a high level of voltage if the input port 2 receives a higher level of voltage than the input port 1. Therefore, the second comparator 200 outputs a high level of voltage. As described above, the second comparator 200 outputs a low level of voltage if the earphone compatible circuit 17 is connected to the third earphone jack 23 for 3-pole earphones. In contrast, the second comparator 200 outputs a high level of voltage if the earphone compatible circuit 17 is connected to the second earphone jack 22 for 4-pole US type earphones. Thus, the controller 16 can identify that the second earphone jack 22 (e.g., as illustrated in FIG. 1) corresponding to 4-pole US type earphones is connected to the earphone interface 18.

Likewise, when the earphone compatible circuit 17 connects to the first earphone jack 21 (e.g., as illustrated in FIG. 1) corresponding to 4-pole European type earphones via the earphone interface 18, the earphone interface 18 is configured in such a way that the contact 3 is 0.7 V due to the connection of the earphone microphone, and the contact 4 is grounded. Therefore, the OR gate 400 receives 0.7 V via the input connected to the contact 3. The OR gate 400 outputs 0.4 V (i.e., due to the voltage drop of 0.3 V) to the second port 2 of the second comparator 200. Meanwhile, because the anode of the diode 410 is grounded, the second comparator 200 receives 0.25 V as a reference voltage via the input port 1. Therefore, the second comparator 200 outputs a high level of voltage if the earphone compatible circuit 17 is connected to the first earphone jack 21 corresponding to 4-pole European type earphones. Thus, the controller 16 can identify that the first earphone jack 21 corresponding to 4-pole European type earphones is connected to the earphone interface 18.

Figure 7:
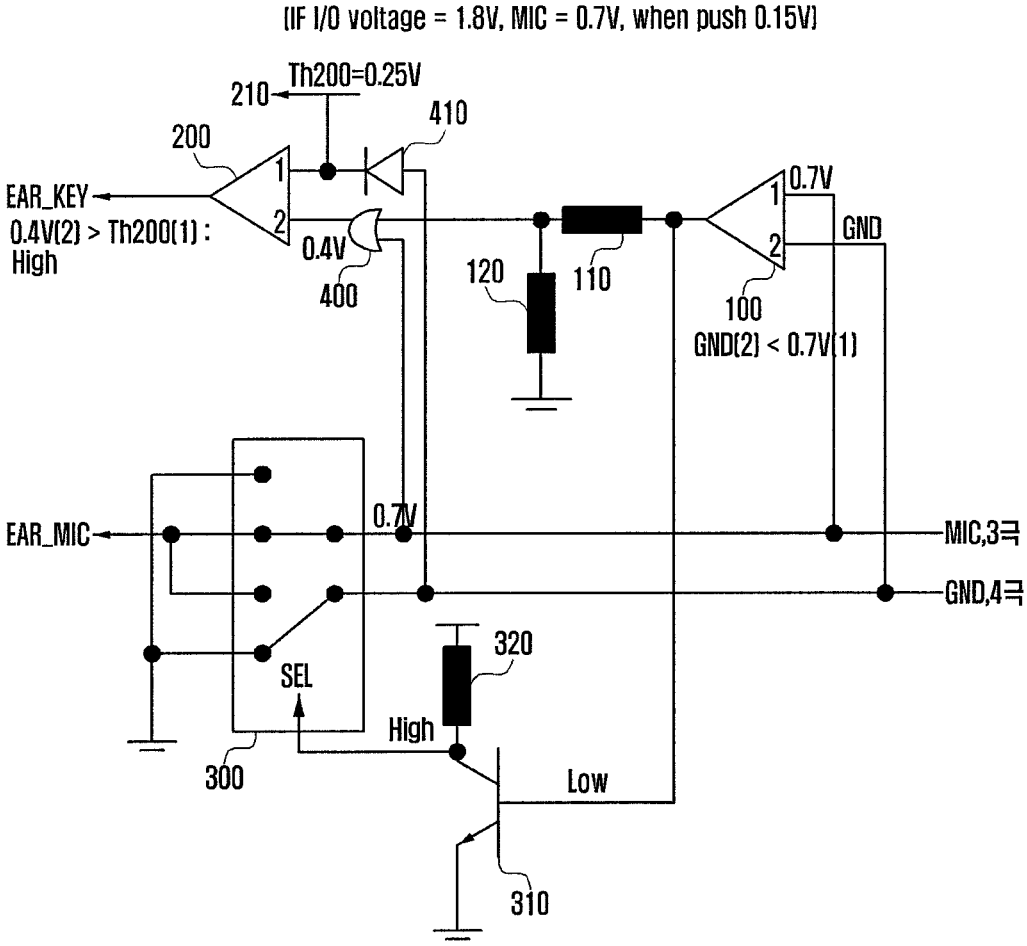
FIG. 7 illustrates an earphone compatible circuit to describe a detection of a key input to a 4-pole European-type earphone jack, according to an exemplary embodiment of the present invention.

FIG. 7 illustrates an earphone compatible circuit to describe a detection of a key input to a 4-pole European-type earphone jack, according to an exemplary embodiment of the present invention.

Referring to FIG. 7, if the earphone compatible circuit 17 connects to the first earphone jack 21 (e.g., as illustrated in FIG. 1) via the earphone interface 18, contacts 3 and 4 of the earphone interface 18 are connected to the microphone contact MIC and the ground contact of the jack 21, respectively. The first comparator 100 is configured in such a way that the input port 1 receives 0.7 V according to the connection of the earphone microphone contact MIC, and the input port 2 is grounded. Because the first comparator 100 receives a larger level of voltage via the input port 1 than via the input port 2, the first comparator 100 outputs a low level of voltage. The switch 310 receives the low level of voltage from the first comparator 100 via the base and thus is turned off. In that case, the I/O voltage (e.g., 1.8 V) corresponding to a high level of voltage, is provided to the selection port SEL of the selector 300 via a third pull-up resistor 320. The selector 300 performs a switching operation such that the input port 2 (e.g., the bottom input port of the selector illustrated in FIG. 7), which is connected to the contact 4 of the earphone interface 18, is switched to the output port 4 (e.g., the bottom output port of the selector illustrated in FIG. 7). The selector 300 also performs a switching operation so that the input port 1 (e.g., the top input port of the selector illustrated in FIG. 7), which is connected to the contact 3 of the earphone interface 18, is switched to the output port 2 connected to the earphone microphone port EAR_MIC of the controller 16. Therefore, the selector 300 connects the earphone microphone contact MIC of the first earphone jack 21 corresponding to 4-pole European earphones to the EAR_MIC port of the controller 16.

The OR gate 400 receives, via the input port, a level of voltage (e.g., 0.7 V) from the contact 3 of the earphone interface 18 connected to the earphone microphone contact MIC of the earphone jack. The OR gate 400 receives, via the other input port, a low level of voltage (i.e., a ground level of voltage), from the output of the first comparator 100. Therefore, the OR gate 400 outputs 0.4 V (i.e., due to the voltage drop) to the second input of the second comparator 200. Thus, the OR gate 400 outputs, to the second comparator 200, a voltage level (i.e., 0.4 V) larger than a level of voltage of the reference voltage supply 210 (i.e., 0.25V). Therefore, because the second comparator 200 receives a reference level of voltage 0.25 V via the input port 1, and 0.4 V, via the input port 2, the second comparator 200 outputs a high level of voltage to the EAR_KEY port of the controller 16. Because the controller 16 receives a high level of voltage via the EAR_KEY port allocated for an earphone key input interrupt, the controller 16 identifies that the earphone interface 18 accepts a jack for 4-poles earphones.

Meanwhile, when the user presses an earphone key in the 4-pole European earphones and the contact 3 of the earphone interface 18, into which the earphone jack 21 is plugged, is shorted to the ground contact. It is assumed that the contact 3 has a short voltage (e.g., approximately 0.15 V). In that case, the first comparator 100 still outputs a low level of voltage. Therefore, the OR gate 400 receives the low level of voltage from the first comparator 100 via an input port and the short voltage (i.e., 0.15 V), rather than the earphone microphone voltage (i.e., 0.7 V) via the other input port connected to the contact 3 of the earphone interface 18. In that case, the OR gate 400 outputs 0.15 V to the second comparator 200. Because the second comparator 200 receives a reference voltage (0.25 V) via the input port 1, and the short voltage (i.e., 0.15 V) via the input port 2. Therefore, the second comparator 200 outputs a low level of voltage. That is, the second comparator 200 outputs a high level of voltage to the EAR_KEY port of the controller 16 (e.g., when the earphone key is not pressed), and then outputs a low level of voltage to the second comparator 200 when the earphone key is pressed. Therefore, in a logic state where the controller 16 can identify an earphone jack 20 corresponding to 4-pole European type earphones, the controller 16 detects a transition of voltage level as a key interrupt. Based on detection of a voltage level as a key interrupt, the controller 16 performs a user function corresponding to the interrupt.

Figure 8:
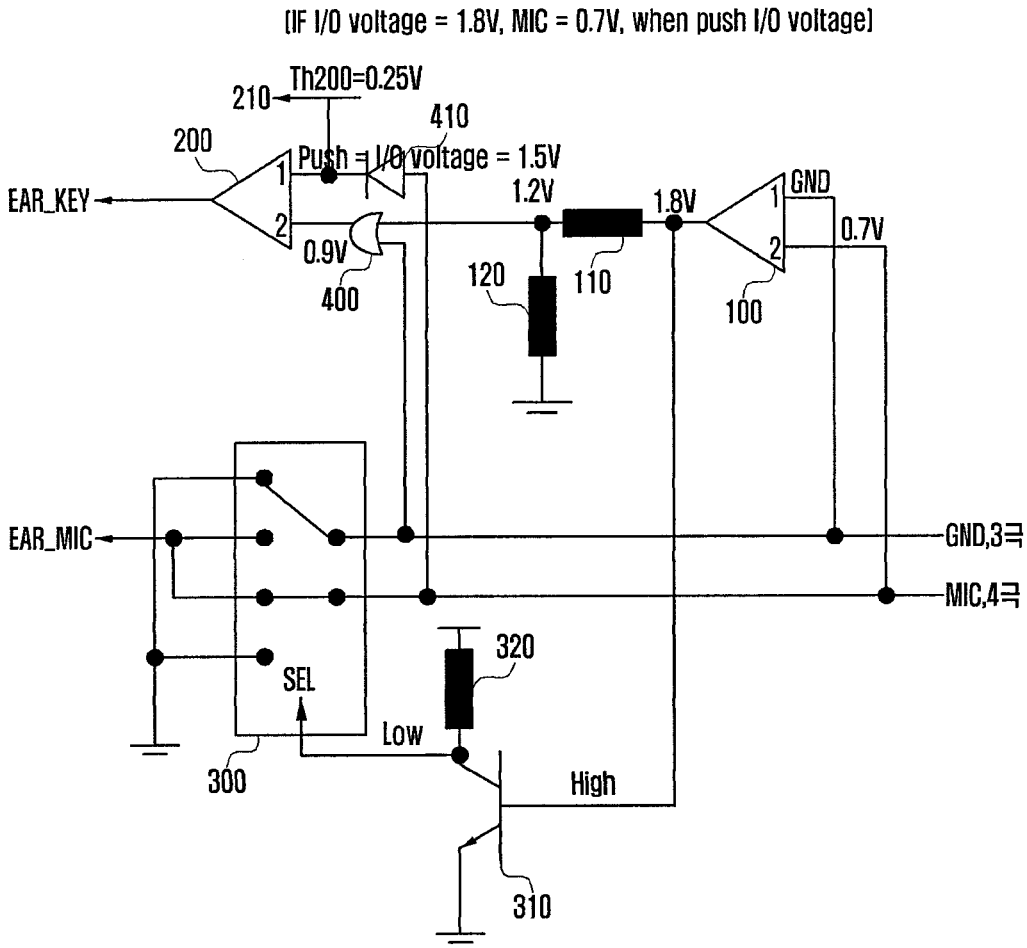
FIG. 8 illustrates an earphone compatible circuit to describe a detection of a key input to a 4-pole US-type earphone jack, according to an exemplary embodiment of the present invention.

FIG. 8 illustrates an earphone compatible circuit to describe a detection of a key input to a 4-pole US-type earphone jack, according to an exemplary embodiment of the present invention.

Referring to FIG. 8, if the earphone compatible circuit 17 connects to the second earphone jack 22 corresponding to 4-pole US type earphones via the earphone interface 18, the contacts 3 and 4 of the earphone interface 18 are connected to the ground contact GND and earphone microphone contact MIC of the jack 22, respectively. The first comparator 100 receives a ground level of voltage via the input port 1 and an earphone microphone voltage of 0.7 V, via the input port 2. Because the first comparator 100 receives a larger level of input (i.e., 0.7 V) via the input port 2 than via the input port 1, the first comparator 100 outputs a high level of voltage. In that case, the first comparator 100 outputs the high level of voltage to a voltage divider and to a switch 310. The voltage divide may include first 110 and second 120 resistors. The switch 310 receives the high level of voltage via the base and is turned on. In that case, the switch 310 allows the current of a pull-up resistor 320 to flow to the ground, and thus outputs a low level of voltage to the selection port SEL of the selector 300. After receiving a the low level of voltage, the selector 300 switches the input port 1, connected to the contact 3 of the earphone interface 18, so to contact the output port 1, and simultaneously switches the input port 2 to the output port 3. Therefore, the contact 4 of the earphone interface 18 is connected to the EAR_MIC port of the controller 16 via the input port 2 and output port 3 of the selector 300. When the earphone interface 18 accepts the second earphone jack 22 corresponding to 4-pole US type earphones, the controller 16 can detect it via the earphone microphone path.

The voltage divider divides the high level of voltage from the output of the first comparator 100 to acquire a level of voltage (e.g., 1.2 V) via the resisters 110 and 120, and outputs the voltage to an input of the OR gate 400. The OR gate 400 receives, via the other input to the OR gate 400, a ground level of voltage from the contact 3 of the earphone interface 18. The OR gate 400 thus receives 1.2 V and 0 V. Due to the drop in voltage caused by physical characteristics of the circuit the OR gate 400 outputs 0.9 V to the input port 2 of the second comparator 200. The diode 410 receives the earphone microphone voltage 0.7 V. As such, due to the drop in voltage caused by physical characteristics of the diode 410, the diode 410 outputs 0.4 V to the input port 1 of the second comparator 200. Because the second comparator 200 receives a higher level of voltage (i.e., a voltage of 0.7 V) via the input port 2 than via input port 1 (i.e., at which the second comparator 200 receives 0.4 V, as a reference voltage), the second comparator 200 outputs a high level of voltage.

When the second earphone jack 22 corresponding to 4-pole US type earphones is implemented with an open key mode and the earphone key is pressed, the contact 4 of the earphone interface 18 increases from 0.7 V to a microphone bias voltage. If the microphone bias voltage is 1.8 V, the first comparator 100 stills outputs a high level of voltage. On the contrary, the second comparator 200 receives, via the input port 1, 1.5 V that the diode receives 1.8 V and outputs by consuming the voltage drop 0.3 V. Therefore, the second comparator 200 receives a voltage lower via the input port 2 than via port 1 (i.e., at which the second comparator 200 receives 1.5 V as a reference voltage). Thus, the second comparator 200 outputs a low level of voltage to the EAR_KEY port of the controller 16. When detecting the alteration/transition of level of voltage input via the EAR_KEY port, the controller 16 can identify that a key input interrupt occurs.

The earphone compatible circuit 17 can be modified variously according to the arrangement in the components, and its detailed description will be provided referring to FIGS. 9 to 12.

Figure 9:
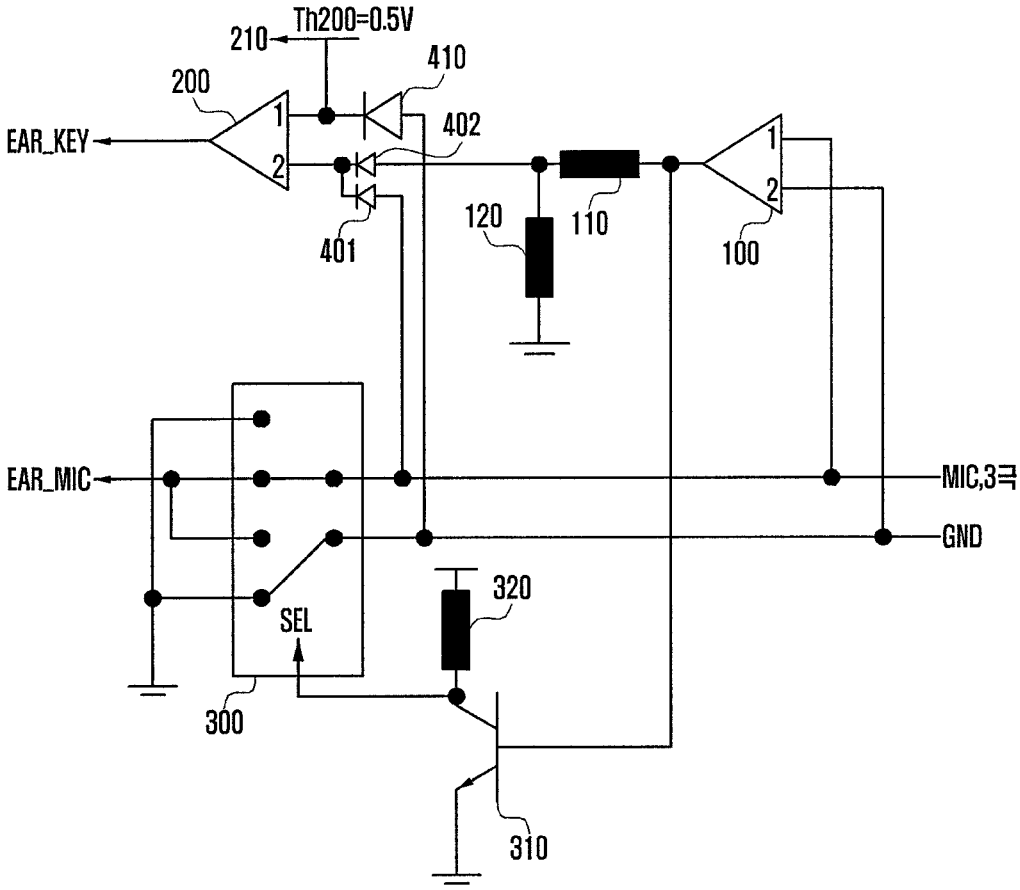
FIG. 9 illustrates a first modification of an earphone compatible circuit according to an exemplary embodiment of the present invention.
Figure 10:
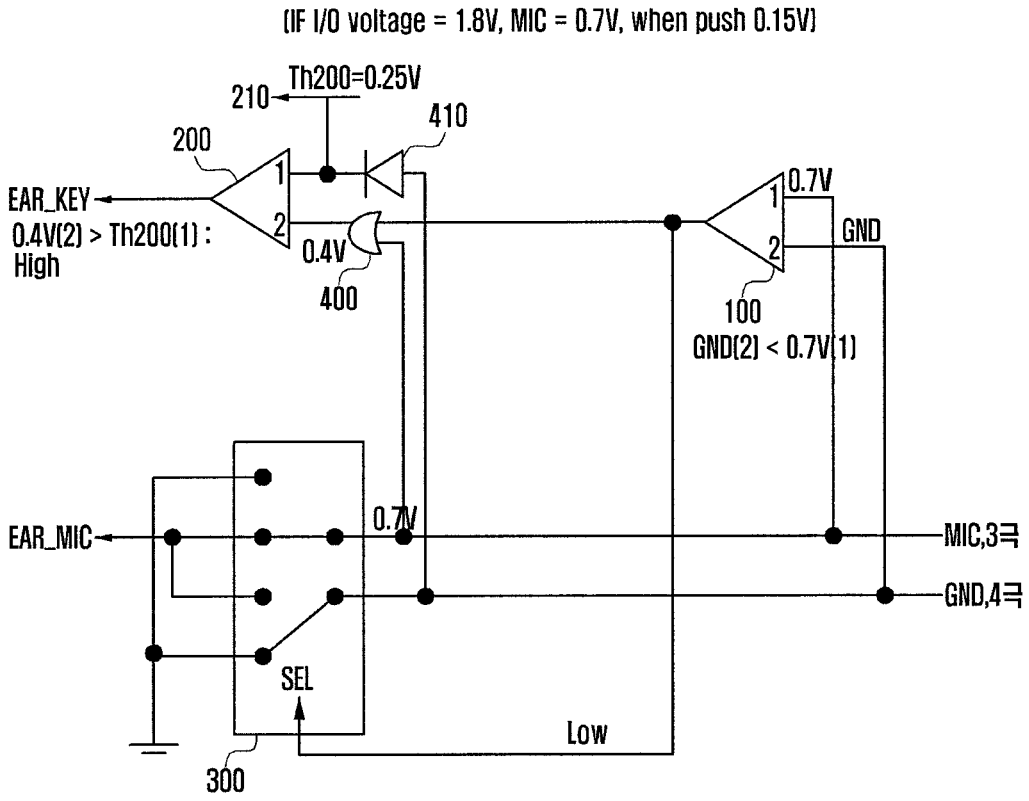
FIG. 10 illustrates a second modification of an earphone compatible circuit according to an exemplary embodiment of the present invention.
Figure 11:
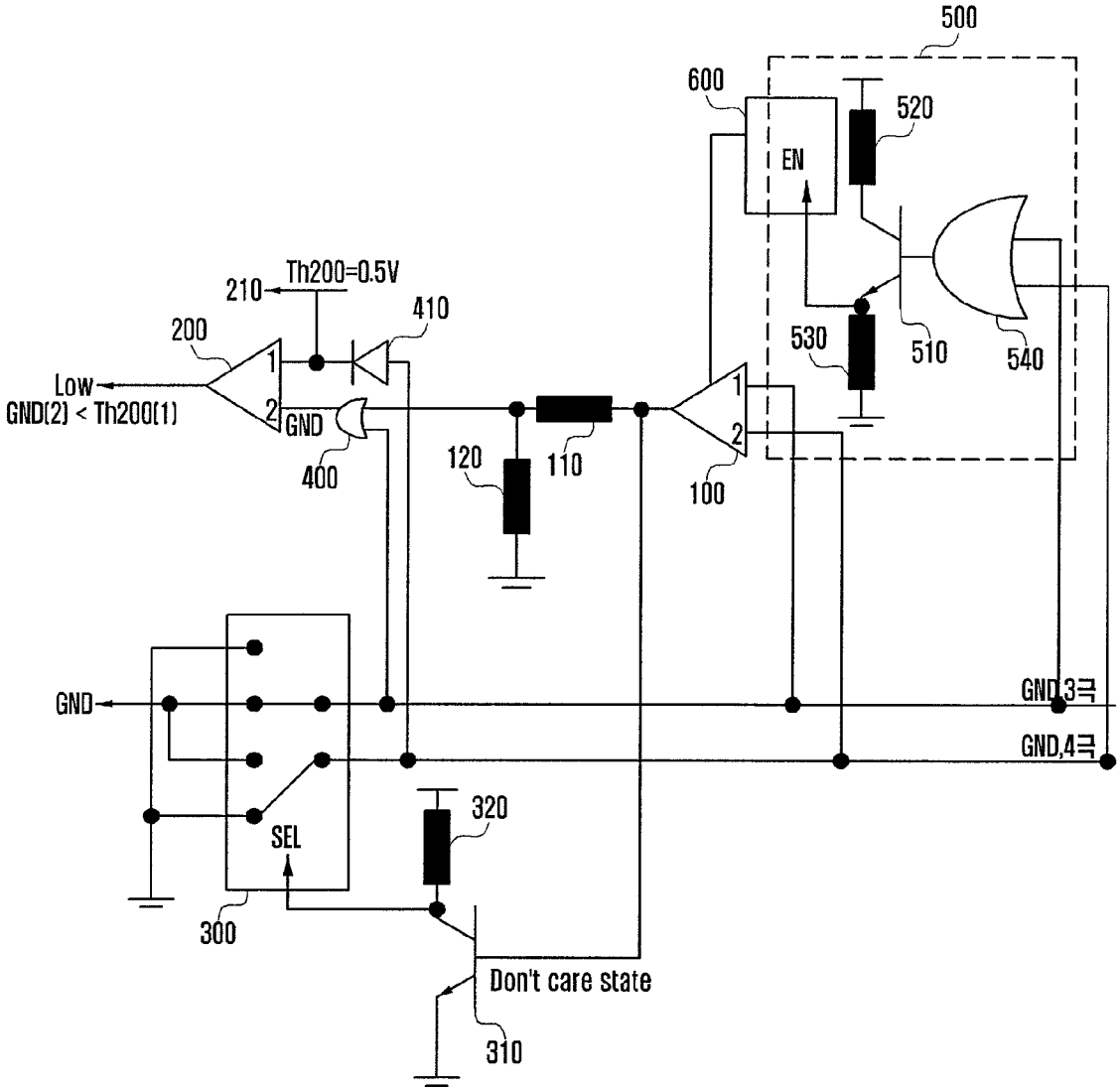
FIG. 11 illustrates a third modification of an earphone compatible circuit with an additional circuit for preventing a comparator from malfunctioning, according to an exemplary embodiment of the present invention.

FIGS. 9 to 11 illustrate modifications of the earphone compatible circuit according to an exemplary embodiment of the present invention.

Referring to FIG. 9, a first modification is implemented in such a way that the OR gate 400 shown in the previous embodiments is replaced with a plurality of diodes in parallel. For example, according to the modification illustrated in FIG. 9, the number of diodes for the OR gate 400 is two (i.e., first diode 401 and second diode 402).

Referring to FIG. 10, a second modification is modified from the previous embodiments by removing the voltage divider if the OR gate 400 outputs a low or high level of voltage that is not altered according to the input. In addition, the second modification is modified from the previous embodiments by removing the switch 310 and the pull-up resistor 320 if the level of voltage input to the selection port of the selector 300, according to the DC feature, is determined by the same DC feature of the level of output from the first comparator 100. Because the second modification does not include the switch 310 shown in the previous embodiments, the selector 300 connects, if the selection port receives a high level of voltage, the output port 3 to the contact 4 of the earphone interface 18 and the output port 1 to the contact 3 of the earphone interface 18. Therefore, the contact 4 of the earphone jack 22 corresponding to 4-pole US-type earphones (i.e., microphone contact MIC) is connected to the EAR_MIC port of the controller 16.

When the first comparator 100 receives the ground level of voltage via the input ports 1 and 2, the first comparator 100 must output a low level of voltage. However, although the first comparator 100 receives the ground level of voltage via the input ports 1 and 2, the first comparator 100 may output a high level of voltage due to the malfunction. To prevent such a malfunction, the third earphone jack 23 corresponding to 3-pole earphones may be modified in such a way as to include an additional circuit for turning off the first comparator 100. That is, when the first comparator 100 receives the ground level of voltage via the input ports 1 and 2 from the 3-pole earphones but outputs a high level of voltage due to the malfunction, the controller 16 may detect that an earphone jack for 4-pole earphones is plugged into the earphone interface 18.

In order to prevent the first comparator 100 from malfunctioning, as shown in FIG. 11, a third modification may be implemented to include an additional circuit in the previous exemplary embodiments. The additional circuit includes a switching unit 500 and a low dropout (LDO) 600. The switching unit 500 includes a second OR gate 540, a second switch 510, and resistors 520 and 530. If the contacts 3 and 4 of the earphone interface 18 are grounded, the third modification can perform a more accurate detection for an earphone jack corresponding to 3-pole earphones. More specifically, when the contacts 3 and 4 of the earphone interface 18 are grounded, the second OR gate 540 outputs a low level of voltage for turning off the second switch 510 to the LDO 600. Because the LDO 600 maintains the turn-off state, the first comparator 100 does not receive the logic voltage from the LDO 600. Therefore, the first comparator 100 outputs no output signal.

When at least one of the contacts 3 and 4 of the earphone interface 18 is biased by the earphone microphone voltage, the second OR gate 540 outputs a high level of voltage to the second switch 510. The second switch 510 is turned on the high level of voltage thereby activating the LDO 600. The LDO 600 receives the electric power via the EN port and is turned on. The electric power for turning on the LDO 600 is produced by the voltage divider of resistors 520 and 530 (i.e., as a fraction of the voltage provided to the resistor 520). For example, the resistor 530 may have a larger resistance than the resistor 520. When the LDO 600 is turned on, the first comparator 100 receives an operation voltage, and the contact 3 or 4 of the earphone interface 18 is connected to the earphone microphone contact MIC. Therefore, the third modification can allow the 4-pole earphones to be normally operated. When the LDO 600 is a component that can be operated with a low level of voltage, the additional circuit is implemented without the second switch 510, and resistors 520 and 530. Likewise, when the second OR gate 540 is biased by a proper voltage and outputs a level of voltage for a corresponding logic level, the additional circuit is implemented without the second switch 510, and resistors 520 and 530. The second OR gate 540 may output a level of voltage sufficiently high to turn on the second switch 510. Otherwise, the third modification requires an additional comparator at the output stage of the second OR gate 540.

Figure 12:
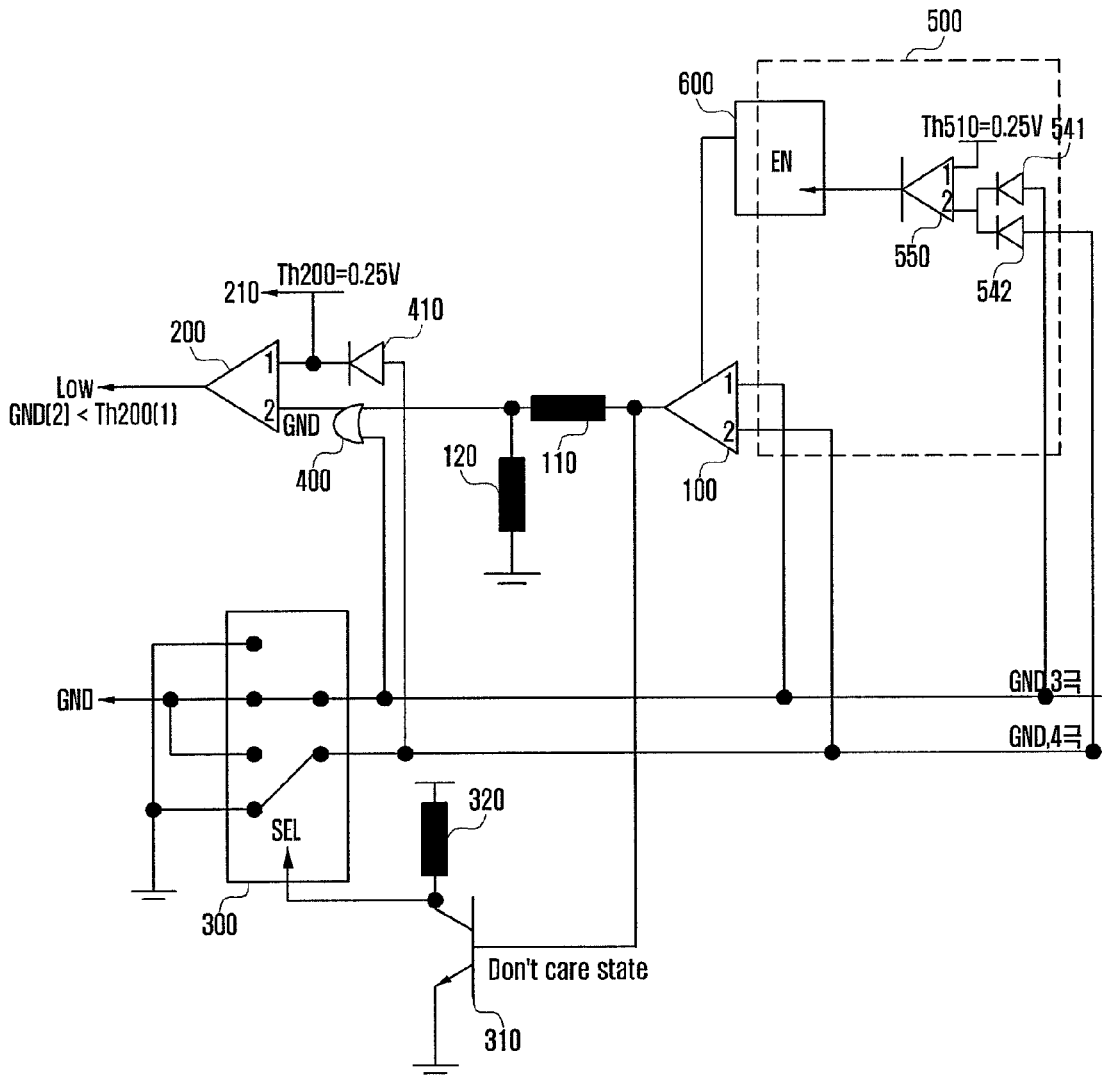
FIG. 12 illustrates a fourth modification of an earphone compatible circuit, modified from the third medication shown in FIG. 11 according to an exemplary embodiment of the present invention.

FIG. 12 illustrates a fourth modification of an earphone compatible circuit, modified from a third medication shown according to an exemplary embodiment of the present invention. The additional circuit includes a third comparator 550, instated of the second switch 510 in the third modification, and a plurality of diodes 541 and 542, rather than the second OR gate 540 included in the third modification.

Referring to FIG. 12, when at least one of the contacts 3 and 4 of the earphone interface 18 is biased an earphone microphone voltage, the input port 2 of the third comparator 550 receives a level of voltage greater than a reference voltage 530. Therefore, like the second comparator 200, the third comparator 550 outputs a high level of voltage to the LDO 600. As described above, when the contacts 3 and 4 of the earphone interface 18 are grounded, the third comparator 550, like the second comparator 200, outputs a low level of voltage to the LDO 600. The first comparator 100 is not biased by a logic voltage because the LDO 600 is not enabled. Therefore, the first comparator 100 outputs no output signal. As an example, the switching unit 500 may be implemented with a PNP device.

Although the modifications are illustrated where the logic voltage is not provided to the first 100, second 200 and third 550 comparators, the modifications can perform the operations described above by adjusting, for example, the reference voltage input to the comparators.

When the second earphone jack 22 for the 4-pole US type, short-key mode earphones is plugged into the earphone interface 18 and an earphone key signal also occurs, the earphone compatible circuit 17 may be operated in such a way that the earphone microphone voltage, which is provided to the contact 4 of the earphone interface 18, is altered from high to low. When the level of voltage is altered in the contact of the earphone interface 18 according to the key input of the short key mode earphones, it is assumed that the level of voltage is altered from 0.7 V to 0.15 V. In that case, the diode 542 outputs a low level of voltage corresponding to 0 V due to the voltage drop. The third comparator 550 receives the reference voltage level from the voltage supply 530 via the input port 1, and the output of the diode 542 via the input port 2. Because the output of the diode 542 is less than the reference voltage level, the third comparator 550 outputs a low level of voltage to the LDO 600. The LDO 600 is turned off and thus does not provide a logic voltage to the first comparator 100. As such, the first comparator 100 outputs a low level of voltage to an input port of the OR gate 400. The OR gate 400 receives, via the other input port, a ground level of voltage according to the mechanical feature of the 4-pole US type earphones. Therefore, the OR gate 400 outputs a low level of voltage. That is, the OR gate 400 alters the output from a high level of voltage to a low level of voltage, and thus outputs the low level of voltage to the input port 2 of the second comparator 200. The second comparator 200 receives the reference voltage via input port 1; and receives the low level of voltage from the OR gate 400. Because the second the reference voltage is lower than the low level of voltage from the OR gate 400, the second comparator 200 outputs a low level of voltage. Therefore, although the second earphone jack 22 for 4-pole US type, short-key mode earphones is plugged into the earphone interface 18, the fourth modification can create a normal interrupt, corresponding to the alteration from a high level of voltage to a low level of voltage according to an earphone key, via the LDO 600 and the switching unit 500, and outputs the interrupt to the controller 16. Therefore, the controller 16 can detect the earphone key input.

Likewise, although the second earphone jack 22 for 4-pole US type, open-key mode earphones is plugged into the earphone interface 18, the fourth modification can restrain, when the earphone key is operated, the third comparator 550 from outputting a low level of voltage, and thus allow for the process of a normal interrupt. In addition, when the first earphone jack 21 for 4-pole European type earphones is plugged into the earphone interface 18, the fourth modification is operated in such a way that the contact 3 of the earphone interface 18, connected to the second comparator 200 and the OR gate 400, is connected to the earphone microphone, and this connection determines the earphone key operations. In that case, the fourth modification is not affected by the output of the first comparator 100, and can thus support the normal key input operation.

As described above, the earphone system according to the present invention can establish a circuit path between the earphones and the controller of the mobile device such that the controller normally detects an earphone jack plugged into the earphone interface of the mobile device, irrespective of the types of jack (i.e., earphones), and supports the earphone function.

As described above, the earphone system according to the present invention can provide compatibility to earphones so that the earphones can be connected to a mobile device.

Although it is not shown in the drawings, the mobile device may selectively further include various types of components, for example: a short-range communication module for short-range communication; a camera module for acquiring still images/videos; an interface for transmitting/receiving data in a wireless or weird mode; an Internet communication module; and a digital broadcast module for receiving and reproducing broadcasts. With the spread of digital convergence, although the mobile device is too various to list their modifications in this description, it will be easily appreciated to those skilled in the art that the other components equivalent to the above-listed components may be further included to the mobile device according to the invention. Also, it will be appreciated that, according to the purposes, the mobile device may be implemented by omitting a particular component or replacing it with other components.

The mobile device according to the invention includes all information communication devices, multimedia devices, and their applications, which include an earphone interface that various types of jacks for earphones are plugged into and are operated according to communication protocols corresponding to various types of communication systems. For example, the mobile device can be applied to mobile communication terminals, Portable Multimedia Players (PMPs), digital broadcast players, Personal Digital Assistants (PDAs), audio players (e.g., MP3 players), mobile game players, smartphones, laptop computers, hand-held PC, etc.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An earphone system, the system comprising:

an earphone interface comprising a plurality of contacts for interfacing with an earphone jack corresponding to each of a 3-pole earphone and a 4-pole earphone;

a controller comprising a plurality of ports for communicating with the earphones that are operatively connected to the earphone interface via the earphone jack; and an earphone compatible circuit configured to:

receive a first signal from a first contact of the earphone interface, the first signal corresponding to a signal from a ground pole of the earphone jack or a signal from a microphone pole of the earphone jack, via the first contact of the earphone interface, receive a second signal from a second contact of the earphone interface, the second signal corresponding to a signal from a ground pole of the earphone jack or a signal from a microphone pole of the earphone jack, via the second contact of the earphone interface, control connection states between the contacts of the earphone interface and the ports of the controller according to a type of the earphone jack interfacing with the earphone interface, the type of the earphone jack being determined based on an outcome of a comparison between the first signal and the second signal, and connect corresponding contacts of the earphone jack to the respective ports of the controller.

2. The system of claim 1, wherein the earphone interface comprises:

four contacts that can be connected to three or more contacts of the earphone jack.

3. The system of claim 2, wherein the four contacts of the earphone interface comprises:

a first contact for connecting to the left output contact of the earphone jack;

a second contact for connecting to the right output contact of the earphone jack;

a third contact for connecting to an earphone microphone contact or ground contact of the earphone jack; and a fourth contact for connecting to a ground contact or an earphone microphone contact of the earphone jack.

4. The system of claim 1, wherein the controller comprises:

an earphone microphone port for connecting to an earphone microphone contact of the earphone jack corresponding to a microphone of the earphones;

an earphone key port for connecting to an earphone key contact of the earphone jack corresponding to a key button of the earphones;

a left output port for connecting to a left output contact of the earphone jack; and a right output port for connecting to a right output contact of the earphone jack.

5. The system of claim 1, wherein the earphone compatible circuit comprises:

a first comparator comprising input ports for respectively connecting to third and fourth contacts of the earphone interface;

an OR gate comprising input ports for respectively connecting to an output port of the first comparator, and the third contact of the earphone interface;

a second comparator comprising input ports for respectively connecting to an output port of the OR gate and the fourth contact of the earphone interface;

a diode operatively connected between the input port of the second comparator and the fourth contact of the earphone interface;

a reference voltage supply operatively connected between the input port of the second comparator and the diode; and a selector for receiving the output of the first comparator via a selection port and for connecting the third or fourth contact of the earphone interface to a port of the controller according to the signal received from the output of the first comparator.

6. The system of claim 5, further comprising:

a voltage divider for dividing the output of the first comparator;

a switch located between the first comparator and the selection port of the selector; and a pull-up resistor for connecting one of the ports of the switch to a voltage supply.

7. The system of claim 5, wherein:

the second comparator outputs a low level of voltage to the controller if the earphone interface accepts an earphone jack comprising 3 contacts, and the selector performs a switching operation such that the third and fourth contacts of the earphone interface are operatively connected to a ground contact, if the earphone interface accepts an earphone jack comprising 3 contacts.

8. The system of claim 5, wherein:

the second comparator outputs a low level of voltage to the controller if the earphone interface accepts an earphone jack corresponding to a 3-pole earphone, and the selector performs a switching operation such that the third and fourth contacts of the earphone interface are operatively connected to a ground contact, if the earphone interface accepts an earphone jack corresponding to a 3-pole earphone.

9. The system of claim 5, wherein:

the second comparator outputs a high level of voltage to the controller, if the earphone interface accepts an earphone jack with 4 contacts, and the selector performs a switching operation such that the third or fourth contact of the earphone interface is connected to an earphone microphone port of the controller if the earphone interface accepts an earphone jack with 4 contacts.

10. The system of claim 5, wherein:

the second comparator outputs a high level of voltage to the controller, if the earphone interface accepts an earphone jack corresponding to a 4-pole earphone, and the selector performs a switching operation such that the third or fourth contact of the earphone interface is connected to an earphone microphone port of the controller if the earphone interface accepts an earphone jack corresponding to a 4-pole earphone.

11. The system of claim 5, wherein if the earphone interface accepts a jack with 4 contacts and an earphone key is pressed, the second comparator alters an output to the controller such that the second comparator alters the output from a high level of voltage to a low level of voltage.

12. The system of claim 1, wherein the earphone compatible circuit comprises:

a first comparator comprising input ports for respectively connecting to third and fourth contacts of the earphone interface;

a first diode comprising an anode for operatively connecting to the output of the first comparator;

a second diode comprising an anode for connecting to a third contact of the earphone interface;

a second comparator comprising first and second input ports, the first port for connecting to cathodes of the first and second diodes, and the second input port for connecting to a fourth contact of the earphone interface;

a selector for selectively connecting the third or fourth contact of the earphone interface to a port of the controller;

a switch for determining a switching state of the selector according to the output of the first comparator;

a diode operatively connected between the second input port of the second comparator and the fourth contact of the earphone interface; and a reference voltage supply operatively connected between the second input port of the second comparator and the diode.

13. The system of claim 12, further comprising:

a voltage divider for dividing the level of voltage output from the first comparator; and a pull-up resistor located between the switch and a selection port of the selector.

14. The system of claim 1, wherein the earphone compatible circuit comprises:

a switching unit for outputting a certain level of voltage according to the voltage output via third and fourth contacts of the earphone interface;

an LDO for providing a logic voltage according to the output of the switching unit;

a first comparator comprising input ports for respectively connecting to the third and fourth contacts of the earphone interface, and the first comparator receiving a signal for a logic voltage from the LDO;

an OR gate comprising input ports for respectively connecting to the output port of the first comparator and the third contact of the earphone interface;

a second comparator comprising input ports for respectively connecting to the output port of the OR gate and the fourth contact of the earphone interface;

a selector for selectively connecting the third or fourth contact of the earphone interface to a port of the controller;

a diode operatively connected between the respective input port of the second comparator and the fourth contact of the earphone interface; and a reference voltage supply operatively connected between the respective input port of the second comparator and the diode.

15. The system of claim 1, further comprising:

a switching unit for outputting a certain level of voltage according to the voltage output via third and fourth contacts of the earphone interface;

an LDO for providing a logic voltage according to the output of the switching unit;

a voltage divider for dividing the level of voltage output from the first comparator;

a switch for determining a switching state of the selector according to the output of the first comparator; and a pull-up resistor located between the switch and a selection port of the selector.

16. The system of claim 15, wherein the switching unit comprises:

a second OR gate comprising input ports for respectively connecting to the third and fourth contacts of the earphone interface; a second switch for providing a reference voltage to the LDO according to the output of the second OR gate; and resistors connected to the second switch for creating the reference voltage.

17. The system of claim 15, wherein the switching unit comprises: a third diode comprising an anode for connecting to a third contact of the earphone interface;

a fourth diode comprising an anode for connecting to a fourth contact of the earphone interface; and a third comparator comprising a first and second input port, the first input port for receiving the outputs from the third and fourth diodes, and the second input port for receiving a reference voltage, and the third comparator outputting an output to the LDO.

18. A method for configuring a connection between a mobile device and earphones, the method comprising:

interfacing an earphone jack of the earphones with an earphone interface of the mobile device, the earphone interface comprising a plurality of contacts that interchangeably interface with various types of earphone jacks including each of a 3-pole earphone and a 4-pole earphone;

receiving a first signal from a first contact of the earphone interface, the first signal corresponding to a signal from a ground pole of the earphone jack or a signal from a microphone pole of the earphone jack, via the first contact of the earphone interface;

receiving a second signal from a second contact of the earphone interface, the second signal corresponding to a signal from a ground pole of the earphone jack or a signal from a microphone pole of the earphone jack, via the second contact of the earphone interface;

controlling a connection state between the plurality of contacts of the earphone interface and ports of a controller of the mobile device based on a type of earphone jack interfacing with the earphone interface, the type of the earphone jack being determined based on an outcome of a comparison between the first signal and the second signal; and connecting corresponding contacts of the earphone jack to the respective ports of the controller.

19. The method of claim 18, further comprising:

transmitting to the controller an interrupt received from the earphone jack interfacing with the earphone interface.

* * * * *